United States Patent [19]

Lübbers

[11] Patent Number: 4,727,811

[45] Date of Patent: Mar. 1, 1988

[54] SMOKE CANISTER WITH CAPILLARY BORES

[75] Inventor: Willi Lübbers, Trittau, Fed. Rep. of Germany

[73] Assignee: Nico-Pyrotechnik Hanns-Jürgen Diederichs GmbH & Co. KG, Hamburg, Fed. Rep. of Germany

[21] Appl. No.: 5,437

[22] PCT Filed: Feb. 25, 1986

[86] PCT No.: PCT/EP86/00096

§ 371 Date: Nov. 21, 1986

§ 102(e) Date: Nov. 21, 1986

[87] PCT Pub. No.: WO86/05582

PCT Pub. Date: Sep. 25, 1986

[30] Foreign Application Priority Data

Mar. 22, 1985 [DE] Fed. Rep. of Germany ..... 3510367

[51] Int. Cl.[4] ..... F42B 13/44

[52] U.S. Cl. ..... 102/334; 102/350

[58] Field of Search ..... 102/334, 341, 350

[56] References Cited

U.S. PATENT DOCUMENTS

| | | | |
|---|---|---|---|
| 1,039,870 | 10/1912 | Wieser | 102/334 X |
| 2,307,369 | 1/1943 | Ferrel | 102/49 |
| 3,898,609 | 8/1975 | Charles | 120/334 X |
| 4,135,455 | 1/1979 | Wallace | 102/217 |
| 4,164,186 | 8/1979 | Beatty et al. | 102/341 |
| 4,353,301 | 10/1982 | Jacobsen | 102/286 X |
| 4,370,929 | 2/1983 | Steinicke et al. | 102/472 X |
| 4,619,202 | 10/1986 | Romer et al. | 102/470 X |

FOREIGN PATENT DOCUMENTS 2056632 3/1981 United Kingdom .

*Primary Examiner*—Peter A. Nelson

*Attorney, Agent, or Firm*—Spencer & Frank

[57] ABSTRACT

An improved smoke canister 1 has a high-pressure proof propellant chamber 20 containing a propellant charge 21, consisting of a reduced-smoke generating powder, which can be ignited electrically by an ignition charge 19. Capillary bores **20*b* and 20*c* are provided respectively in both end faces of the propellant chamber 20. When a smoke canister 1 is fired, propellant gases under high pressure exit via the capillary bore 20*b* into the launcher (not shown), and contribute to the uniform acceleration of the smoke canister 1. This makes it possible to launch heavier smoke canisters. The smoke-generating charge 12 is ignited by means of the second capillary bore 20*c***.

11 Claims, 4 Drawing Figures

SMOKE CANISTER WITH CAPILLARY BORES

BACKGROUND OF THE INVENTION

The invention relates to a smoke canister of the type which includes a casing to contain a smoke-generating charge and which includes a lid for the casing, the lid containing ignition and propellant charges and having a periphery with electrical contact rings.

Smoke canisters of the species described in more detail at the outset are known from German Laid-Open application DE-OS No. 15 78 348. Their main purpose is the self-protection of vehicles of every kind, especially combat tanks, and they are therefore carried on such vehicles and are fired from launchers externally attached to the vehicle. Customary launchers, distributed in large numbers, are designed for a maximum gas pressure of about 13.5 Bar, so that only a propellant charge mostly consisting of black powder (which generates a low gas pressure) can be used for the launching of smoke canisters. It would be desirable, because of the achievable increase in protection, to launch smoke canisters having a larger smoke-generating charge from the vehicles seeking protection. However, this is not easily possible with customary launchers because of their comparatively low resistance to pressure. Furthermore, the black powder propellant charges usually employed have the disadvantage that they foul the electrical contacts for the firing of the smoke canisters to a high degree.

Especially when it is impossible to clean immediately after the launching of the smoke canisters, heavy corrosion effects occur, leading to difficulties with the contacts and, at the least, making repeated launches of the smoke canisters more difficult.

SUMMARY OF THE INVENTION

It is an object of the invention to provide an improved smoke canister which makes assured self-protection possible at greater speed a with customary smoke canisters, and which avoids fouling of the contacts. Such fouling would impair the assurance of operation.

This object is attained, based on a smoke canister of the species described at the outset in more detail, by providing a container having first and second end faces and having a high-pressure proof propellant chamber between the end faces, the container being mounted in the lid with the first end face oriented toward the smoke-generating charge, the first end face having a capillary bore and the second end face having a single capillary bore, the diameter of the second capillary bore ranging from about 1 mm to about 1.4 mm, wherein the propellant and ignition charges are disposed in the propellant chamber.

DESCRIPTION OF THE PREFERRED EMBODIMENT

Figure 1:
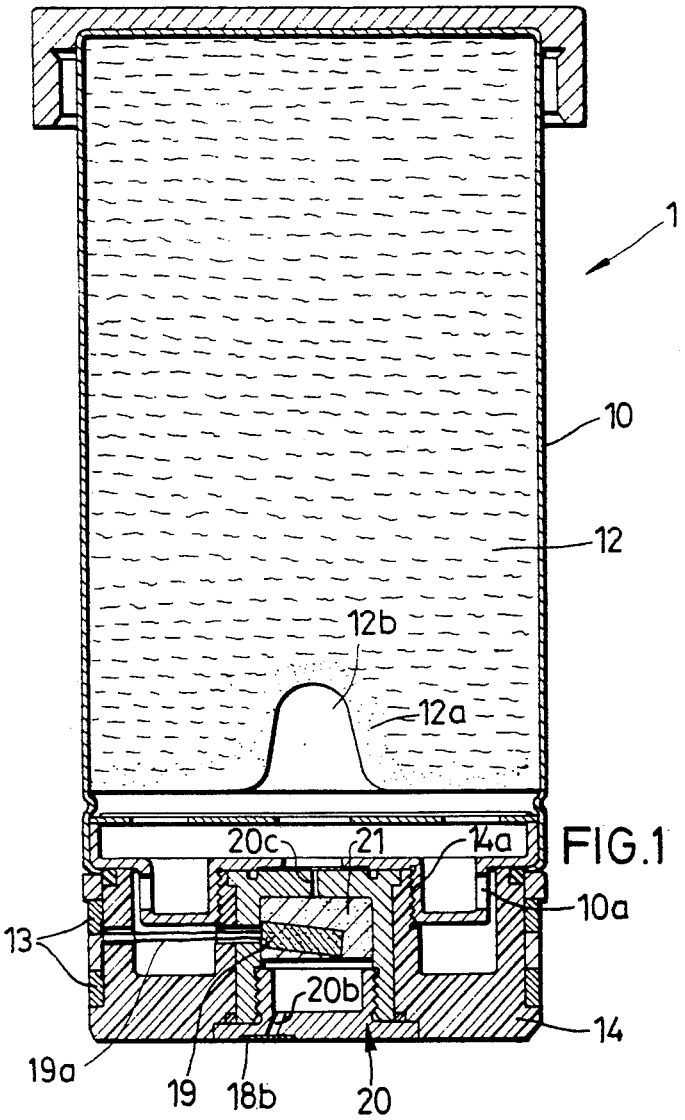
FIG. 1 is a longitudinal sectional view through the smoke canister.
Figure 2:
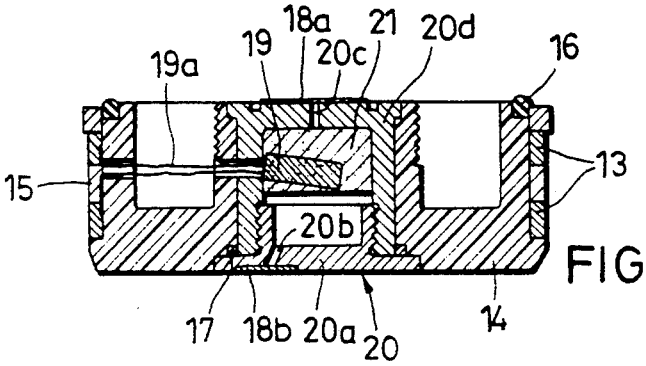
FIG. 2 is a longitudinal sectional view through the base of the smoke canister.
Figure 3:
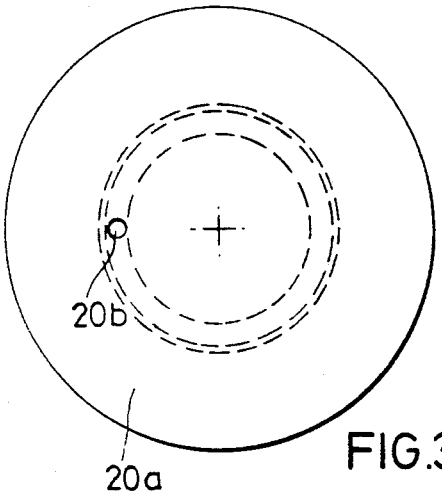
FIG. 3 is a plan view of the base of the propellant chamber shown in expanded scale.

FIG. 1 shows in a longitudinal section view a smoke canister 1, comprising a casing 10 preferably made by the deep drawing method, into which is injected the smoke-generating charge 12. The casing 10 is closed by a lid 14 having on its circumference two contact rings 13 separated by an insulating ring (see FIG. 2). The launcher, not shown here, consists in general of a cylindrical jacket and a base, and at the height of the said contact rings 13 the launcher has contact pins which are disposed in the launcher jacket in a spring-loaded and insulated manner. During firing the launcher's contact pins apply voltage to the smoke canister 1. This voltage is applied via electrical wiring 19*a*, connected with the contact rings 13, to an ignition charge 19, which is in the form of a electrical priming cap (FIG. 1, FIG. 2). The customary black powder propellant charge is also ignited in this manner and it creates propellant gases to launch the smoke canister 1, the pressure level of which does not exceed the pressure stability of the launcher. However, customary black powder propellants foul the contact means to a high degree and thereby decrease the operational assurance.

The object of the invention is to improve self-protection by launching smoke canisters with a greater smoke charge, without exceeding the permissible pressure level and with greatly increased assurance of operation. This is accomplished by a novel propulsion system described in detail below.

Figure 4:
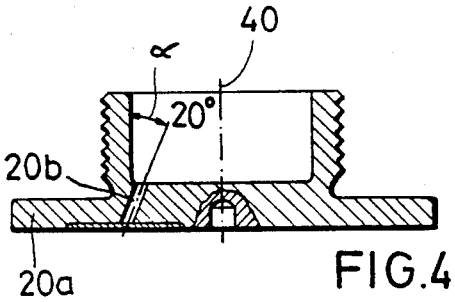
FIG. 4 is a longitudinal sectional view through the base of the propellant chamber.

After ignition of traditional black powder propellant charges a prescribed pressure level, which does not exceed the maximum pressure stability of the launcher, is created, and this pressure level steadily decreases after the start of the acceleration phase of the smoke canister up to the point where the canister is discharged. In contrast, the invention provides that a constant pressure level, not exceeding the maximum pressure stability of the launcher, is created in the launcher in spite of the acceleration of the smoke canister. The constant pressure level is maintained practically to the point of the final discharge of the smoke canister, whereby the launched smoke canister is steadily accelerated. For this purpose the smoke canister 1 in accordance with the invention has a high-pressure resistant propellant chamber 20 wherein a high-caloric, reduced-smoke generating powder 21 (for example, a nitro powder) is disposed as propellant. Powder 21 is electrically fired by the ignition charge 19. The propellant chamber 20, inserted in the lid 14 of the smoke canister 1, consists of a generally cup-shaped housing 20*d* which is closed by means of a screw-on lid 20*a* to form a container. In both end faces of the propellant chamber 20 capillary bores 20*b* and 20*c*, respectively, are disposed. To improve the storage life, bores 20*b* and 20*c* are covered with covers 18*a* and 18*b*, for example a self-adhesive foil of metal or plastic. Covers 18*a* and 18*b* prevent the entry of moisture into the propellant charge 21. After ignition of the propellant charge 21 by the electrical ignition of the ignition charge 19 via the contact rings 13 and the connecting wires 19*a*, a comparatively high pressure of a magnitude of approximately 1,000 Bar builds up in the propellant chamber 20 because of the conversion of the propellant powder 21. The propellant gases under high pressure in the propellant chamber 20 enter the bore 20*b*, rip the lid 18*b* apart, and then enter a moat-like indentation which is delimited by the outer wall of the launcher and a support spike rising in its center, on which the ready-to-be-launched smoke canister 1 rests. By proper dimensioning of the bore **20*b* the propellant gases under high pressure are throttled in such a way that inside the launcher only such a pressure level arises which does not exceed its maximum pressure stability. However, since propellant gas is steadily fed via the bore 20*b* even after the start of acceleration of the smoke canister 1, this pressure level is maintained inside the launcher until the smoke canister 1 has completely vacated the launcher. In this manner is created—contrary to traditional smoke canisters—a constant acceleration inside the launcher during the dwell time of the smoke canister 1 inside the launcher, whereby the same launch distances can be achieved with heavier smoke canisters. The bore 20*b* is appropriately disposed at an angle, preferably at an angle $\alpha$ of between 18° and 25°, preferably 20°, to the longitudinal axis 40 (FIG. 4) of the propellant chamber 20, so as to let the propellant gases reach the annular indentation of the launcher (not shown). The diameter of the bore 20*b* is between 1 mm and 1.4 mm. In an especially advantageous exemplary embodiment of the invention the diameter of the bore 20*b*** is 1.2 mm.

The capillary bore **20*c* is disposed in the front face of the propellant chamber 20 facing the smoke-generating charge 12, and the cover 18*a* is provided for storage purposes. After ignition of the propellant charge 21 the hot propellant gases also enter the bore 20*c*, penetrate the cover 18*a*, and ignite the smoke-generating charge 12 in an area 12*a* adjacent the bore 20*c*, where the smoke-generating charge 12 surrounds an indentation 12*b*. Due to the ignition of the smoke-generating charge 12 in area 12*a* a very high pressure builds up between the smoke-generating charge 12 and the lid 14 of the smoke canister 1 which closes the casing 10. This pressure finally causes the thread 14*a*, by means of which the lid 14 is fastened to the smoke canister, to begin to give and finally to tear, so that an annular slit is formed between the lid 14 and the cross section of the smoke canister 1 covered by it, the pent-up smoke clouds can exit through the slit. In this way a dense curtain of smoke offering initial protection is already created during the flight of the smoke canister 1 by the conically extending trail of smoke. The lid 14 is completely blown off during the flight. After the smoke canister 1 lands, the smoke generated by the burning smoke-generating charge 12 can exit through openings 10*a*, disposed evenly around the periphery of the smoke canister 1**, without hindrance, so that a wall of smoke, offering concealment, is quickly formed.

The tearing of the thread **14*a* and the removal of the lid 14 are promoted by the fact that part of the lid 14 surrounding the high-pressure proof steel propellant chamber 20, especially the outer thread 14*a* contained therein, consists of plastic, while the inner thread, connected with the casing 10**, is made of steel.

The propellant chamber 20, made of steel, insulates in an advantageous and sure way the electrically activatable ignition charge 19 against electro-magnetic impulses, which otherwise could cause an unwanted firing.

The propellant gases created from the propellant charge 21 which—as previously described—enter the launcher via the bore **20*b*, do not cause a noticeable fouling or corrosion of the contact pins disposed in the launcher. Accordingly safe reloading of the launcher and firing of smoke canisters 1** are possible without special cleaning measures being needed. In this way maintenance costs are considerably reduced and assurance of function is assured.

What I claim is:

1. A smoke canister, comprising:

a casing;

a smoke-generating charge in the casing;

a lid attached to the casing, the lid having a periphery;

electrical contact rings on the periphery of the lid;

a container having first and second end faces and having a high-pressure proof propellant chamber between the end faces, the container being mounted in the lid with the first end face oriented toward the smoke-generating charge, the first end face having a first capillary bore, the second end face having a single second capillary bore, the diameter of the second capillary bore ranging from about 1 mm to about 1.4 mm;

a propellant charge in the propellant chamber; and an ignition charge in the propellant chamber, the ignition charge being electrically connected to the contact rings.

2. A smoke canister in accordance with claim 1, wherein the propellant charge is a reduced smoke-generating powder.

3. A smoke canister in accordance with claim 1, wherein the propellant chamber has a longitudinal axis which runs through the first and second end faces, and wherein the second capillary bore is disposed at an angle in relation to the longitudinal axis of the propellant chamber.

4. A smoke canister in accordance with claim 1, wherein the container is made of steel and the lid is made of plastic.

5. A smoke canister in accordance with claim 1, further comprising covers for the bores.

6. A smoke canister in accordance with claim 1, wherein the smoke-generating charge has an indentation adjacent the first bore.

7. A smoke generating canister in accordance with claim 5, wherein each cover is a self-adhesive foil segment.

8. A smoke canister in accordance with claim 1, wherein the casing is a deep drawn casing, and wherein the propellant chamber is cylindrical.

9. A smoke canister in accordance with claim 1, wherein the diameter of the second capillary bore is about 1.2 mm.

10. A smoke canister in accordance with claim 2, wherein the reduced smoke-generating powder is a nitro powder.

11. A smoke generating canister in accordance with claim 3, wherein the angle is about 20°.

* * * * *